United States Patent [19]

Durrell et al.

[11] Patent Number: 4,643,096

[45] Date of Patent: Feb. 17, 1987

[54] SAFETY AND ARMING MECHANISM

[75] Inventors: Robert R. Durrell, Glendale; Kenneth E. Willis, Litchfield Park, both of Ariz.

[73] Assignee: Unidynamics Phoenix, Inc., Phoenix, Ariz.

[21] Appl. No.: 800,742

[22] Filed: Nov. 22, 1985

[51] Int. Cl.[4] ..... F42C 15/24; F42C 15/28

[52] U.S. Cl. ..... 102/250; 102/228; 102/229; 102/254

[58] Field of Search ..... 102/250, 247, 248, 254, 102/255, 256, 263, 264, 229, 228, 223

[56] References Cited

U.S. PATENT DOCUMENTS

| | | | |
|---|---|---|---|
| 1,205,921 | 11/1916 | Moren | 102/247 |
| 2,807,210 | 9/1957 | Wales et al. | 102/250 |
| 2,938,463 | 5/1960 | Jasse | 102/250 |
| 3,126,828 | 3/1964 | Tafel | 102/250 |
| 3,610,154 | 10/1971 | Brown | 102/242 X |
| 3,919,941 | 11/1975 | Breed et al. | 102/250 |
| 4,078,497 | 3/1978 | Castelli | 102/228 |

FOREIGN PATENT DOCUMENTS

| | | | |
|---|---|---|---|
| 1256033 | 2/1961 | France | 102/250 |

*Primary Examiner*—David H. Brown

*Attorney, Agent, or Firm*—Cahill, Sutton & Thomas

[57] ABSTRACT

A set back weight is moved by inertial force from a first position to a second position during acceleration of a missile. The set back weight is biased toward its first position to preclude its movement to its second position until the missile undergoes the rate of acceleration which is normally associated with a successful launch of the missile. Upon reaching the second position the weight becomes connected to a piston disposed in a fluid containing reservoir so that when the missile undergoes a reduction in its rate of acceleration and the set back weight moves toward its first position that movement is transmitted to the piston to express fluid from the reservoir. Fluid from the reservoir flows into a working cylinder to move an arming piston therein. Movement of the arming piston is slowed to delay arming of the missile by a flow restricting orifice in the path of fluid flow from the reservoir to the working cylinder.

8 Claims, 6 Drawing Figures

SAFETY AND ARMING MECHANISM

TECHNICAL FIELD

This invention is concerned with a mechanism for preventing premature ignition of the explosive in a missile.

BACKGROUND ART

All military missiles, whether guided or unguided and whether self-propelled or fired from a gun or other propulsion launcher, for safety reasons are equipped with means for preventing the explosive charge in the missile from becoming armed, i.e. capable of being ignited, until the missile is successfully launched and is well clear of the launching vehicle. Of the many safety and arming mechanisms which have been conceived in the past for this purpose some have been designed to sense the acceleration of the missile as an indication of a successful, or proper, launch. U.S. Pat. Nos. 1,205,921 granted Nov. 21, 1916 to H. Moren for "Safety Device for Shell Fuses", 3,610,154 granted Oct. 5, 1971 to David B. Brown for "Acceleration-Actuated Mechanism", and 3,919,941 granted Nov. 18, 1975 to David S. Breed et al for "Liquid Timing Device" all disclose arming mechanisms which sense acceleration of the missile to initiate an arming procedure. To insure that the missile is clear of the launching vehicle the safety and arming mechanism may also include a timing system to delay arming the missile for a predetermined period of time following successful launch. The aforementioned Brown patent discloses a mechanical movement time delay system for this purpose. The aforementioned Breed et al patent discloses the use of a, so called, sharp edge orifice dashpot traveling through a liquid as a timing mechanism. Prior safety and arming mechanisms as exemplified by the devices disclosed in the Brown and the Breed et al patents, have been rather complex. Complexity usually goes hand in hand with lessened reliability. The more parts a mechanism possesses the more opportunity there is for faulty assembly or component failure to interfere with the intended operation of the mechanism. An extremely high degree of reliability is required for munitions and prior safety and arming mechanisms have often failed to meet that requirement.

A safety and arming mechanism is expendable with the missile so it is desirable to hold the cost of the mechanism to a minimum. And, the more complex the mechanism the more costly the mechanism. This further dictates a demand for a simple, but reliable, safety and arming mechanism.

DISCLOSURE OF THE INVENTION

Like some prior safety and arming mechanisms the mechanism of this invention utilizes a set back weight movable from a first position to a second position in response to acceleration of the missile during launch. The mechanism further includes means for biasing the set back weight to its first position when the missile is not experiencing acceleration.

To delay arming of the missile for a predetermined time period following a successful launch the mechanism of this invention includes a hydraulic timing device comprising a fluid reservoir having a piston therein, a working cylinder with an arming piston therein and a flow restricting orifice providing communication between the reservoir and the working cylinder. The orifice in effect meters the flow of fluid from the reservoir to the working cylinder and governs the time required to move the arming piston on an armed position. Movement of the piston in the reservoir is effected by the biasing means acting on the set back weight. In accordance with the invention, means are provided for connecting the set back weight to the reservoir piston when the set back weight has moved fully to its second position.

The means connecting the set back weight to the reservoir piston preferably includes a connector member attached to the reservoir piston and having a tapered cross section and a circumferential groove in its surface adjacent the larger cross sectional portion of the tapered region. A split ring carried by the set back weight rides up the tapered surface on the connector member as the set back weight moves from its first to its second position and drops into the circumferential groove when the set back weight reaches its second position to positively connect the weight to the reservoir piston.

BRIEF DESCRIPTION OF THE DRAWINGS

The invention is described in greater detail hereinafter by reference to the accompanying drawings wherein.

BEST MODE FOR CARRYING OUT THE INVENTION

The safety and arming mechanism of this invention is adapted to be carried within the body of an explosive missile and to serve the dual function of preventing arming of the missile until: (1) the missile has undergone a predetermined degree of acceleration indicating a successful launch of the missile, and (2) a predetermined minimum interval of time has elapsed following launch of the missile indicating that the missile is well clear of the launching site. The mechanism also insures against accidental arming of the missile as a result of environmental conditions encountered or handling conditions experienced prior to launch of the missile. The mechanism of the invention is simple and low-cost and yet possesses an extremely high degree of reliability.

Figure 1:
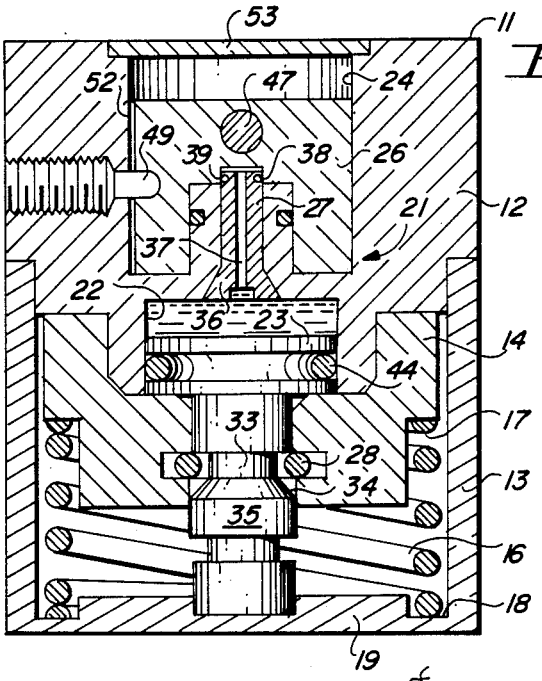
FIG. 1 is a vertical sectional view through a safety and arming mechanism embodying this invention.

FIG. 1 illustrates a safety and arming mechanism embodying this invention and depicts the various components of the mechanism in the positions they occupy when the mechanism is in its unarmed, or safed, condition. The mechanism may be conveniently housed in a cylinderical casing 11 having an upper portion 12 and a lower portion 13. Although the sizes of the various components of the mechanism are not critical, it is to be noted that, primarily because of the simplicity of the mechanism, it occupies very little space. Thus, the mechanism can easily be housed in a casing 11 the maximum diameter and height of which can be anywhere from 50 to 100 millimeters. This enables the mechanism to be utilized in relatively small missiles and projectiles.

The safety and arm mechanism is disposed in the missile with the longitudnal axis of its casing 11 disposed parallel to the longitudinal axis of the missile with the upper end of the casing 11 as viewed in FIG. 1 disposed toward the forward end of the missile.

Figure 2:
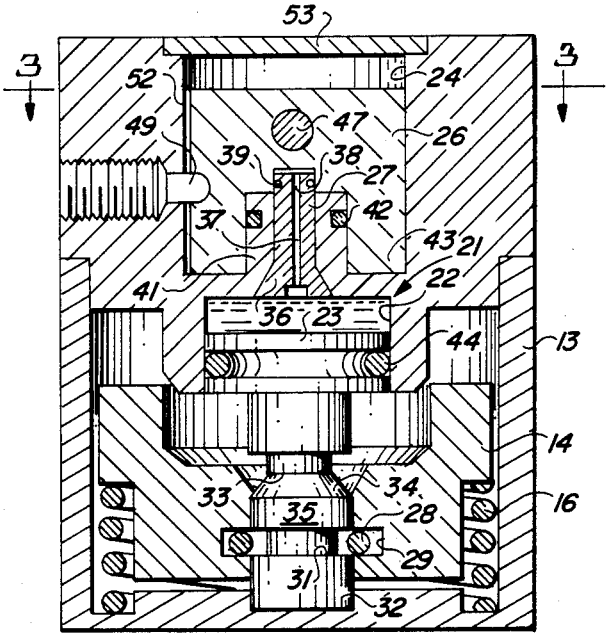
FIG. 2 is a view similar to FIG. 1, but showing the components of the mechanism in the positions they occupy immediately following a successful launch of a missile containing the mechanism.

That portion of the safety and arming mechanism which senses acceleration of the missile during launch comprises an annular set back weight, or mass, 14. When the missile accelerates during launch the set back weight 14 moves under inertial force from a first position (as shown in FIG. 1) to a second position (as shown in FIG. 2) against biasing means in the form of a helical compression spring 16 disposed between a shoulder 17 on set back weight 14 and a retaining groove 18 in the bottom wall 19 of casing lower portion 13.

When set back weight 14 reaches its second position, indicating that the missile has undergone the degree of acceleration representing a good launch, the set back weight 14 is connected to a timer means to allow final arming of the missile after an appropriate time delay. The means connecting the set back weight to the timer means enables the energy stored in compression spring 16 during acceleration to be employed to drive the timing means when the missile is no longer accelerating and the spring 16 is moving set back weight 14 back toward its first position.

The preferred timing means utilized in practicing this invention is of the hydraulic variety. This timing means is indicated generally by reference numeral 21 and comprises a fluid containing reservoir 22 having a piston 23 therein for expressing fluid from the reservoir, a working cylinder 24 having a working, or arming, piston 26 therein and orifice means 27 providing controlled communication between reservoir 22 and working cylinder 24. Orifice means 27 controls the rate of fluid flow from reservoir 22 to the space beneath working piston 26 and thereby determines the time required to transfer sufficient fluid into working cylinder 24 to move working piston 26 to its armed position. The construction is such that the fluid flows at a constant velocity even over a wide temperature range.

The means for connecting the hydraulic timing means 21 to set back weight 14 to allow spring 16 to move reservoir piston 23 and actuate the timing means is provided by a split, or snap, ring 28 carried in a recess 29 in the inner face of set back weight 14 and adapted to snap into a circumferential groove 31 in the surface of a connecting rod, or member, 32 extending coaxially from the reservoir piston 23. It will be appreciated that with snap ring 28 occupying both the groove 31 in connecting rod 32 and a portion of the recess 29 in set back weight 14 that the set back weight and the connecting rod are locked together so that movement of weight 14 from its second position toward its first position under the influence of compression spring 16 moves reservoir piston 23 into the reservoir to expel fluid therefrom in the manner illustrated in FIG. 4. This results in arming piston 26 being moved upwardly in working cylinder 24.

Snap ring 28 may also be utilized to assist in controling the movement of set back weight 14 during launch to impart the desired sensitivity of the set back weight to acceleration of the missile. This is accomplished by providing on the connecting rod 32 a reduced cross sectional region 33 in which snap ring 28 can rest in a relatively unstressed condition when the set back weight 14 is in its first position (FIG. 1) prior to launch of the missile. Adjoining reduced cross sectional region 32 is a tapered surface region 34 leading to an enlarged cross sectional region 35 adjoining circumferential groove 31 in the surface of the connecting rod 32. The purpose of this surface configuration on connecting rod 32 is to utilize the force generated by forced expansion of snap ring 28 to resist and to slow movement of set back weight 14 from its first position to its second position during acceleration of the missile. As inertial force commences to move set back weight 14 downwardly along connecting rod 32, snap ring 28 engages the tapered region 34 on the connecting rod and must be expanded in order to ride up to the larger cross sectional region 35. The force required to expand snap ring 28 is in effect added to the force exerted by compression spring 16 in resisting movement of set back weight 14. By selective design of the characteristics of compression spring 16 and snap ring 28 it is possible to preset the acceleration to which the set back weight 14 must be subjected in order for it to move to its second, or cocked, position, shown in FIG. 2.

A typical safety and arming device for a projectile type missile might have the compression spring 16 and snap ring 28 designed to allow the set back weight to commence movement when subjected to a minimum acceleration force of approximately 650 g and to allow the set back weight to translate its full stroke to its second position at a minimum force of 1000 g. The compression rate of the spring and the expansion rate of snap ring 28 under these acceleration forces dictate that acceleration forces must be maintained for some finite, although small, period of time such as 10 miliseconds, in order for the set back weight to move through its full stroke to its second position. Any reduction in or loss of acceleration prior to the set back weight 14 reaching its second position will result in return of the set back weight 14 toward its first, or safe, position preventing initiation of the arming sequence for the mechanism. Thus, even though the missile may be subjected to severe instantaneous forces, such as might be encountered if the missile were dropped, the construction of the mechanism is such as to prevent the set back weight from moving to its second position under that type of force.

In accordance with the invention the timing means 21 is equipped with features which enhance its reliability. The first of these concerns the construction of the orifice means 27 and its relationship with the arming piston 26. It will be noted that the orifice means 27 is provided by a machined plug 36 having a restricted passage 37 therein. The upper end of plug 36 is adapted to be received in a recess 38 in arming piston 26. When arming piston 26 is in its safe, unarmed, position as shown in FIGS. 1 and 2 the upper end of plug 36 is tightly received in recess 38 of piston 36 and precludes fluid from reservoir 22 from accidentally exiting the restricted passage 37. If desired, the plug end may be provided with an O-ring 39 for further enhancing the seal between the plug and piston 26. The small area of recess 38 in relation to the area of reservoir piston 23 assures that when piston 23 commences to move to express fluid from reservoir 22 a significant pressure of fluid will be built up in recess 38 to cause arming piston 26 to move away from the end of plug 36. Thus, the plug 36 in cooperation with the recess 38 in piston 26 acts as a poppet valve to initiate movement of the piston 26 when fluid is expressed from reservoir 22. To further preclude loss of fluid from timing means 21 it is desirable to provide in the upper portion 12 of casing 11 an upstanding boss 41 having an O-ring 42 on its outer surface for sealingly engaging the inner surface of a skirt portion 43 of arming piston 26. Also, the reservoir piston 23 preferably has an O-ring 44 providing a seal between that piston and the walls of reservoir 22.

In operation of the timing means 21 the size of the restricted passage 37 in orifice means 27 and the characteristics of compression spring 16 control the rate at which fluid in reservoir 22 can be displaced from the reservoir and flow into the region beneath the arming piston 26. A hydraulic system of this type has excellent reliability and can provide accurate time delay periods over a wide range of environmental conditions. For example, a two second time delay can be provided by this apparatus with an accuracy of ±0.2 seconds. Virtually any type of hydraulic fluid can be employed in the timing means 21 although a preferred fluid for this application is a mixture of graphite and polytetrafluorethylene powders inasmuch as this mixture will assure a constant velocity and, hence, flow rate through the orifice throughout a broad temperature range.

Figure 3:
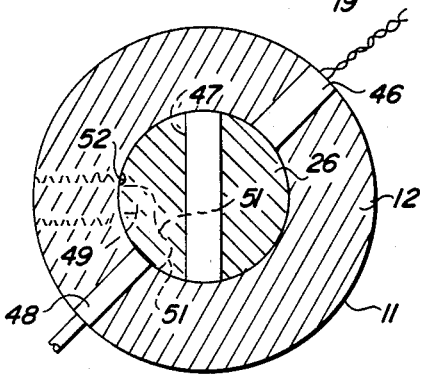
FIG. 3 is a horizontal sectional view taken generally as indicated by the line 3—3 in FIG. 2.
Figure 4:
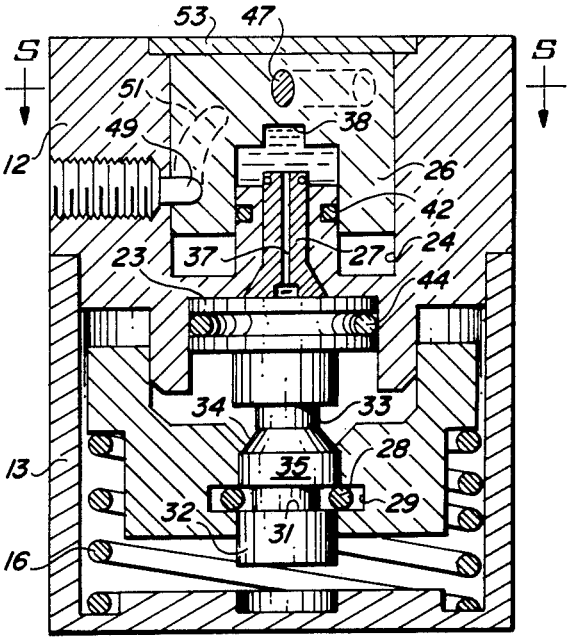
FIG. 4 is another view similar to FIG. 1, but showing the components of the mechanism in their armed positions following successful launch and a predetermined time delay after that launch.

When arming piston 26 has been moved upwardly in the cylindrical casing 11 to the position illustrated in FIG. 4 the safety and arming mechanism has completed the arming process. Movement of piston 26 could be utilized to effect arming of the missile in a variety of ways. The arming apparatus chosen to illustrate the best mode for carrying out the invention is a mechanical interrupter in the detonation train. This train includes an electrically activated detonator 46 fixedly positioned in a bore in the casing upper portion 12, a movable transfer lead 47 contained in a bore in the arming piston 26 and a booster explosive lead 48 also fixedly positioned in a bore in casing portion 12. With arming piston 26 in its safe position as shown in FIGS. 1, 2 and 3 the transfer lead 47 is displaced from and out of alignment with the coaxially positioned detonator and booster explosive lead 48. This interrupts the continuity of the explosive train so that if for some reason the detonator 46 is fired the detonation is not transmitted to the booster explosive lead 48 and, hence, not to the main body the explosive.

Figure 6:
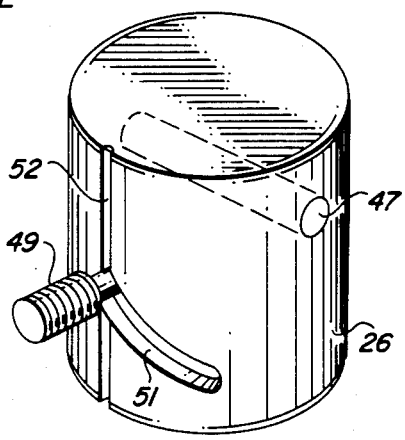
FIG. 6 is a large perspective view of a working piston employed in the arming mechainism.
Figure 5:
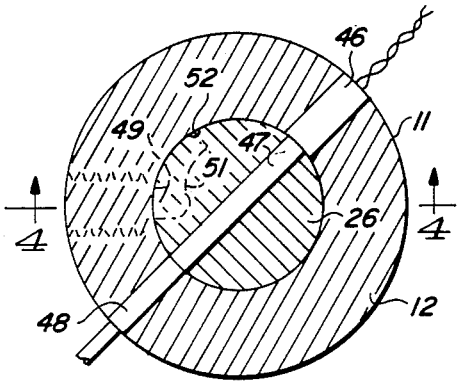
FIG. 5 is a horizontal sectional view taken generally as indicated by line 5—5 in FIG. 4.

When the arming mechanism is called upon to arm the missile the components of the mechanism assume the positions illustrated in FIGS. 4 and 5 in which arming piston 26 has moved upwardly as a consequence of fluid having been pumped beneath its surface. During this upward movement the piston is caused to rotate about its axis by a cam follower 49 which rides in a cam groove 51 on the surface of piston 26 (see FIG. 6). This upward turning movement of piston 26 brings the transfer lead 47 into alignment with the detonator 46 and booster explosive lead 48 establishing continutiy for the detonation train. This allows the main body of the explosive in the missile to be ignited by activation of detonator 46.

The top opening in the casing upper portion 12 is preferably closed and sealed by means of a plate 53 which can, if desired, be welded in place. A vent groove 52 longitudinaly extending along the surface of piston 26 allows any air trapped above the piston to be released to the space beneath the piston so as not to interfere with arming movement of piston 26.

From the foregoing it should be apparent that the safety and arming mechanism of this invention is both simple in construction and reliable. The coaxial disposition of the major components such as the set back weight the reservoir piston 23 and the working piston 26 eliminates the need for any connecting levers or the like and allows for low cost machining of the upper and lower portions 12 and 13 of the casing 11 for housing the mechanism.

What is claimed is:

1. A safety and arming mechanism for a missile comprising a set back weight movable from a first position to a second position in response to acceleration of the missile during launch, means biasing said set back weight toward its first position, a fluid reservoir, a piston in said reservoir, means for connecting said set back weight to said reservoir piston when the weight has moved from its first position to its second position whereby when said weight is moved toward its first position thereafter by said biasing means said reservoir piston is moved to expel fluid from said reservoir, a working cylinder having an arming piston therein and means comprising a flow restricting orifice providing communication between said reservoir and said working cylinder.

2. The mechanism of claim 1 wherein said arming piston has a bore therein substantially smaller in cross sectional area than the cross sectional area of the reservoir piston and there is a poppet extension in communication with said flow restricting orifice received in sealing relationship in the said bore of said arming piston.

3. The mechanism of claim 1 further comprising means resisting relative movement between said set back weight and said reservoir piston.

4. The mechanism of claim 2 wherein said resisting means comprises a connector member secured to said reservoir piston, said connector member having a tapered surface with a narrow region and a wide region thereon, and an expandable ring associated with said set back weight and adapted to ride on said tapered surface from the narrow region to the wide region thereof as the weight moves from its first position to its second position.

5. The mechanism of claim 4 wherein said connector member also has a locking groove formed therein and said ring cooperates with said locking groove to comprise the said means for connecting said set back weight to said reservoir piston.

6. A safety and arming mechanism for a missile, mechanism having a longitudinal axis adapted to be disposed parallel to the longitudinal axis of the missile, a working cylinder, an arming piston disposed in said cylinder, a fluid reservoir having fluid therein, a piston in said reservoir, means providing restricted communication between said reservoir and said working cylinder, said arming piston and said reservoir piston being coaxially arranged on the axis of the mechanism with the arming piston forward of said reservoir piston in the direction of intended movement of the missile, a set back weight coaxially disposed with respect to said reservoir piston and movable from a first position to a second position in response to acceleration of the missile during launch, means biasing said set back weight toward its first position, and means for connecting said set back weight to said reservoir piston when the weight is moved from its first position to its second position.

7. The mechanism of claim 6 wherein said connecting means comprises a connector member coaxially extending from said reservoir piston and having a circumferential groove in the surface thereof and an expandable ring carried by said set back weight and movable thereby along the surface of said connector member to said groove.

8. The mechanism of claim 7 wherein the surface of said connector member tapers from a smaller cross section region to a larger cross section region toward said groove whereby the force required to expand said ring as it moves over said tapered surface resists relative movement of said set back weight and said connector member.

* * * * *